United States Patent [19]

Lindström

[11] 4,303,207

[45] Dec. 1, 1981

[54] SCREENING APPARATUS

[75] Inventor: Alf I. Lindström, Sundsbruk, Sweden

[73] Assignee: Sunds Defibrator Aktiebolag, Sweden

[21] Appl. No.: 121,924

[22] Filed: Feb. 15, 1980

[30] Foreign Application Priority Data

Feb. 20, 1979 [SE] Sweden ..... 7901473

[51] Int. Cl.[3] ..... B02C 7/02; B07B 1/08

[52] U.S. Cl. ..... 241/261.2; 209/240; 209/209; 209/271; 209/379; 210/360.2

[58] Field of Search ..... 209/271, 270, 273, 303, 209/304, 272, 305, 306, 233, 379, 359, 361, 627, 628, 659, 240; 210/360 A, 374; 233/2; 241/221, 242, 260, 261.2; 162/55, 380

[56] References Cited

U.S. PATENT DOCUMENTS

| | | | |
|---|---|---|---|
| 1,185,794 | 6/1916 | Haug | 209/270 |
| 1,187,731 | 6/1916 | Haug | 209/270 |
| 1,420,685 | 6/1922 | Burch | 209/379 X |
| 1,505,315 | 8/1924 | Cretors | 209/627 |
| 2,002,404 | 5/1935 | Lamort | 209/270 |
| 2,312,545 | 3/1943 | Haug | 210/374 X |
| 3,363,759 | 6/1968 | Clarke-Pounder | 209/273 |
| 3,785,969 | 1/1974 | Mölls | 210/415 X |

FOREIGN PATENT DOCUMENTS

| | | | |
|---|---|---|---|
| 457099 | 7/1968 | Switzerland | 210/360 A |

*Primary Examiner*—Robert Halper

*Attorney, Agent, or Firm*—Lerner, David, Littenberg & Samuel

[57] ABSTRACT

Screening apparatus for fractionating material suspensions has a screen gap which is defined by a rotatable member and a stationary member. One of these members is provided with at least one projection which extends into the screen gap to inhibit clogging of the gap with coarse suspension materials. Any coarse suspension materials stuck in the screen gap can be removed from the screen gap by a wiper element extending from the rotatable member and overlapping the screen gap.

16 Claims, 4 Drawing Figures

SCREENING APPARATUS

FIELD OF THE INVENTION

This invention relates to apparatus for cleaning and/or fractionating material suspensions under pressure, preferably in cellulose and paper mills, and, more particularly, to such apparatus which utilize screens of the closed centripetal type where screening takes place through screen gaps. The invention is particularly adapted for separating coarse particles, such as knots and other coarse material, from a pulp suspension with a concentration of 1–10%, suitably 2–7% and preferably 3–5%.

BACKGROUND OF THE INVENTION

Screening apparatus are known in which a screen gap is formed between a pair of relatively movable parts. The operating efficiency of such apparatus can be deleteriously affected if material suspensions clog the screen gap, thereby inhibiting the screen gap from effectively performing its screening function.

In the past, efforts have been made to prevent the clogging of the screen gaps of these apparatus. For instance, Haug U.S. Pat. No. 1,185,794 describes and illustrates a screening machine designed to automatically clean screen openings formed between relatively movable parts. Inasmuch as the screening machine of the Haug patent relies solely on the relative movement of the parts to cause stock, which cannot pass through the screen openings, to bypass the screen openings, there is nothing which positively inhibits clogging of the screen openings by rejecting or defibrating the stock. Thus, the screening machine of the Haug patent suffers from the problem that some of the stock might not bypass the screen openings, which could therefore become clogged by the unbypassed stock.

SUMMARY OF THE INVENTION

The present invention overcomes many of the disadvantages and shortcomings described above by rejecting or defibrating coarse material in suspensions which are screened through a gap formed between a pair of relatively rotatable members, thereby inhibiting the clogging of the gap with the coarse material. In one especially advantageous embodiment of the invention, one of the members is provided with at least one projection which extends into the gap. The projection or projections can be attached to a stationary one of the members or a rotatable one of the members substantially adjacent an outer peripheral edge thereof.

Another aspect of the invention involves a removal device adapted to remove any coarse material stuck in the gap. The removal device, which may include a plurality of wiper elements, extends from the rotating member and overlaps the gap.

The gap communicates between a supply chamber positioned radially outwardly of the gap and a collecting chamber positioned radially inwardly of the gap. Material suspensions contained within the supply chamber can be guided in a desired direction by designing the removal device such that it produces pulsations in the material suspensions. The rotating member may be designed so as to generate pulsations in material suspensions passing through the gap to the collecting chamber, thereby facilitating the cleaning of the gap.

DESCRIPTION OF THE DRAWINGS

For a more complete understanding of the present invention, reference may be had to the following description of an exemplary embodiment taken in conjunction with the accompanying figures of the drawings, in which.

DESCRIPTION OF AN EXEMPLARY EMBODIMENT

Figure 2:
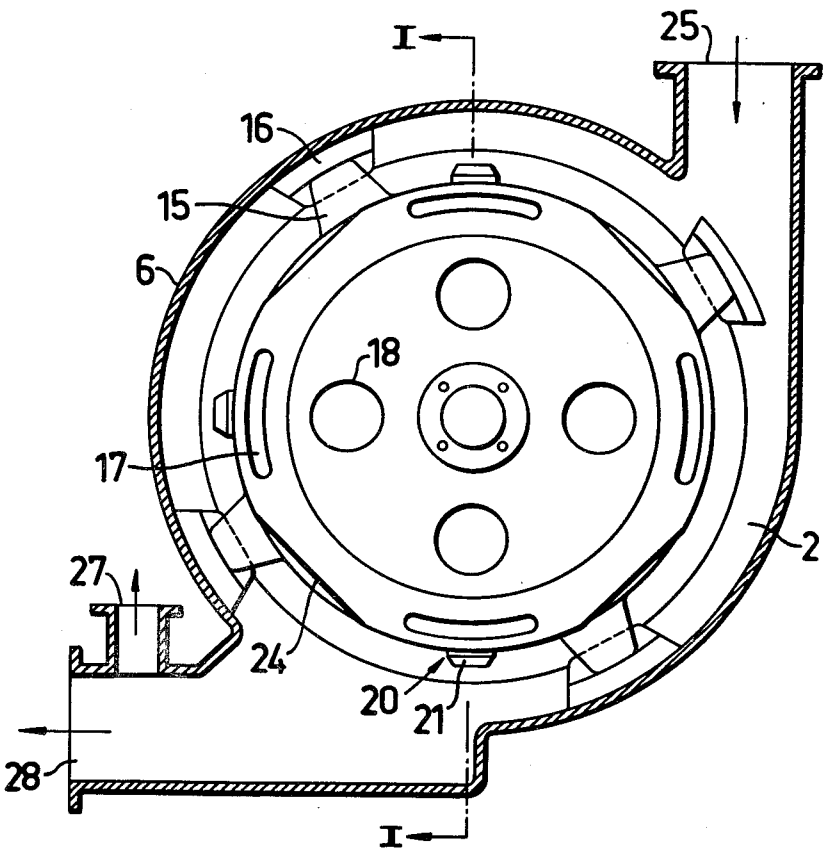
FIG. 2 is a cross-sectional view, taken along the line II—II in FIG. 1 and looking in the direction of the arrows, of the screening apparatus shown in FIG. 1.

Referring to FIGS. 1-4, there is shown a screening apparatus adapted to screen a pulp suspension. The screening apparatus includes a circular screening device 1 capable of separating coarse particles, such as knots (rejected pulp suspension), from the pulp suspension (injected pulp suspension), which is delivered to a supply chamber 2, located radially outwardly of the screening device 1, through an inlet 25. A collecting chamber 3 is located radially inwardly of the screening device 1 so as to receive the pulp suspension (accepted pulp suspension), which passes through each of four screen gaps 4. The supply chamber 2 is defined by a substantially planar sidewall 5, a frusto-conical wall 6 and a spherical sidewall 7.

The screening device 1 includes two rotatable annular members 9 and three stationary annular members 13, 14 which define the four screen gaps 4. The rotatable annular members 9 are attached to a rotor 10, which is supported on and rotated by an axle 11. The axle 11 is journalled in two bearings (not shown) located in spaced mutual relationship externally of the sidewall 5. The axle 11, which can be rotated by a suitable drive source, such as an electric motor, is sealed against the collecting chamber 3 by a suitable sealing means 12, which may be designed as a so-called mechanic plane seal. The stationary annular members 13, which flank the stationary annular member 14, are attached to the sidewalls 5 and 7, respectively. The stationary annular member 14 is attached by lugs 15 to shoulders 16, which extend radially inwardly from the frusto-conical wall 6.

Figure 1:
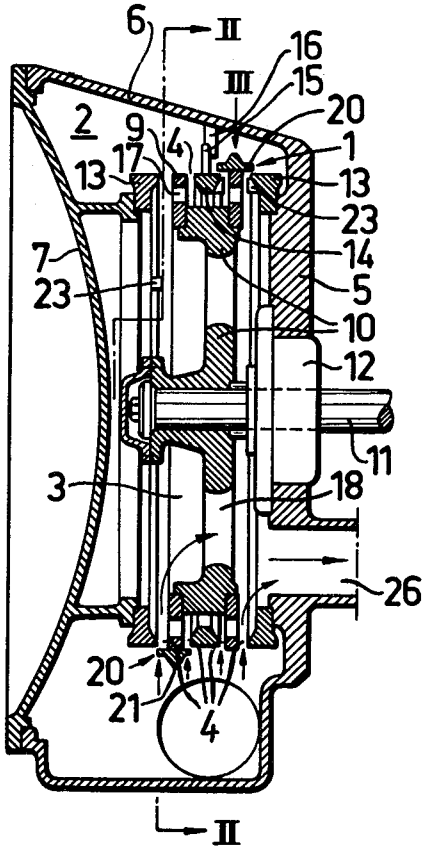
FIG. 1 is a cross-sectional view, taken along the line I—I of FIG. 2 and looking in the direction of the arrows, of a screening apparatus constructed in accordance with the present invention.
Figure 4:
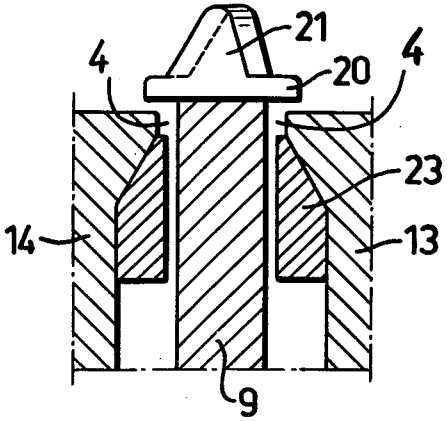
FIG. 4 is a cross-sectional view, taken along the line IV—IV of FIG. 3 and looking in the direction of the arrows, of the portion of the screening apparatus shown in FIG. 3.
Figure 3:
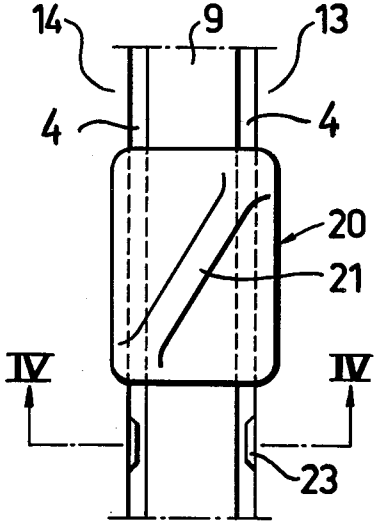
FIG. 3 is a detailed view, looking in the direction of arrow III in FIG. 1, of a portion of the screening apparatus illustrated in FIG. 1.

The arrows in FIG. 1 indicate the flow path of the pulp suspension through the screen gaps 4. As indicated by these arrows, after passing through the outermost two of the screen gaps 4, the accepted pulp suspension flows directly into the collecting chamber 3. Inasmuch as the rotor 10 constitutes an obstruction to the accepted pulp suspension which has passed through the innermost two of the screen gaps 4, the rotatable annular members 9 are provided with four openings 17, which permit communication between the innermost two of the screen gaps 4 and the collecting chamber 3. Radially extending openings (not shown) can also be provided in the outer peripheral portion of the rotor 10 so as to communicate with the innermost two of the screen gaps 4, whereby these openings, either alone or together with the openings 17, permit passage of the accepted pulp suspension to the collecting chamber 3. Inasmuch as the rotor 10 is provided with openings 18, the accepted pulp suspension can flow freely to an outlet 26 from that portion of the collecting chamber 3 which is located on the side of the rotor 10 opposite the outlet 26.

In order to prevent knots or other coarse material from getting stuck in the screen gaps 4, the stationary annular members 13, 14 are provided with projecting members 23, which extend into the screen gaps 4. The projecting members 23 can be attached to the stationary annular members 13, 14 by, for example, hard surfacing, welding, or soldering stellite plates thereon. Alternatively, the projecting members 23 can be formed integrally with the stationary annular members 13, 14. It is also possible to provide the projecting members on the rotatable members 9. The projecting members 23 prevent clogging of the screen gaps 4 by rejecting or defibrating the coarse material contained in the injected pulp suspension.

Each of the projecting members 23 preferably has a planar surface, which is parallel to the surfaces on the stationary annular members 13, 14 and the rotatable annular members 9 which define the screen gaps 4. At a gap width of 2–6 mm, the projecting members 23 extend axially inwardly approximately 1–2 mm and circumferentially approximately 2–30 mm, suitably 5–20 mm and preferably 10–15 mm. The projecting members 23 provided on any one of the stationary annular members 13, 14 or the rotatable annular members 9 may number one to ten, suitably two to five and preferably three to four.

In order to further improve the cleaning of the screen gaps 4, the rotatable annular members 9 can be provided with cleaning members 20, each of which overlaps one or preferably two of the screen gaps 4. Upon rotation of the rotatable annular members 9, the cleaning members 20 sweep past the stationary annular members 13, 14 in close proximity thereto, thereby releasing knots or other coarse material stuck in the screen gaps 4. Alternatively, the rotatable annular members 9 can be provided with cleaning fingers projecting into the screen gaps 4. Preferably, at least two cleaning members 20 or fingers are provided, but the number may be greater depending upon the amount of coarse impurities in the inject and/or whether the cleaning members 20 are designed so as to produce a transportation, fluidization or pulsation effect, for example, by means of a blade 21 mounted thereon. One of the cleaning members 20 is shown in an enlarged scale in FIGS. 3 and 4. A primary object of the blade 21 is to guide the pulp suspension toward the sidewall 7.

So as to produce a radial pulsation and cleaning effect, each of the rotatable annular members 9 can be formed with four planar portions 24, which preferably extend over the entire thickness of the corresponding one of the rotatable annular members 9. Each pair of adjacent planar portions 24 is preferably separated by a circumferential portion of the corresponding one of the rotatable annular members 9. The number of the planar portions 24 provided on any one of the rotatable annular members 9 should be at least two, but may also be three, four or, under certain conditions, five or more. All of the rotatable annular members 9 need not have the same number of the planar portions 24 and, alternatively, they may have none.

Although there are four screen gaps 4, the number of the screen gaps 4 may be increased or decreased, for example, to two or three. Whenever the screen gaps 4 number more than one, each of the screen gaps 4 is positioned the same distance, measured in a radial direction, from the axle 11.

As shown in FIG. 1, the surfaces defining the screen gaps 4 are parallel to each other. However, the distance between adjacent ones of the stationary annular members 13, 14 and the rotatable annular members 9 increases, at least along a portion of the radial extent thereof, as the distance from the axle 11 decreases. Each of the screen gaps 4 is continuous and has a width of 1–8 mm, suitably 2–6 mm and preferably about 3 mm when knots are to be separated from cellulose pulp. The width of the screen gaps 4 can also be decreased, for example, to 0.25 mm, so that the screening apparatus can be utilized for fine screening of a pulp suspension from which the knots have already been removed. The width of the screen gaps 4 is changed simply by replacing the rotatable annular members 9 and/or the stationary annular members 13, 14.

In addition to the inlet 25 for the injected pulp suspension and the outlet 26 for the accepted pulp suspension, the screening apparatus has an outlet 27 for the rejected pulp suspension and an outlet 28 for scrap. The scrap outlet 28 leads to a scrap chamber, from which the scrap is tapped when necessary. A stand (not shown) carries the screening apparatus, which is mounted thereon with its axle 11 extending horizontally. The apparatus also can be mounted with its axle 11 extending vertically or at some angle to the vertical or horizontal.

The mode of operation of the screening apparatus is as follows. The injected pulp suspension is supplied through the inlet 25 and enters into the annular supply chamber 2. The accepted pulp suspension passes through the screen gaps 4 into the collecting chamber 3 and then flows out through the outlet 26. The rejected pulp suspension is removed through the outlet 27, and scrap is removed from the outlet 28. The outlet 26 is pressurized, the pressure in the outlet 26 being less than the pressure in the inlet 25. When knots are to be separated from pulp suspension, good results are obtained at a pressure difference of 0.2–0.6 kp/cm$^2$ above the screen gaps 4.

In test runs of a screening apparatus adapted to separate knots and having a total gap surface (open area) of 0.03 m$^2$, a capacity of 300 t/24 hours was measured. The injected pulp suspension had a concentration of 3–5%, and the rejected pulp suspension had a concentration of 10–15%.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

What is claimed is:

1. Screening apparatus for fractionating pulp suspensions under pressure, comprising a closed housing; a first member positioned in said housing; a second member positioned in said housing on one side of said first member and arranged coaxially with and parallel to said first member, said second member being rotatable relative to said first member and cooperating therewith to form an open circumferential screening gap between adjacent outer peripheral edges of said first and second member; a supply chamber located in said housing radially outwardly of said screening gap and communicating therewith; a collecting chamber located in said housing radially inwardly of said screening gap and communicating therewith; and defibrating means for defibrating coarse suspension materials passing from said supply chamber to said collecting chamber through said screening gap, said defibrating means including at least one projection extending into said screening gap from one of said first and second members, whereby said at least one projection rejects as well as defibrates coarse materials in pulp suspensions passing from said supply chamber to said collecting chamber through said screening gap so as to inhibit clogging of said screening gap.

2. Apparatus according to claim 1, wherein said first member is stationary and said second member is rotatable.

3. Apparatus according to claim 2, wherein said at least one projection extends from said first member substantially adjacent said outer peripheral edge thereof.

4. Apparatus according to claim 2, wherein said at least one projection extends from said second member substantially adjacent said outer peripheral edge thereof.

5. Apparatus according to claim 1, further comprising a third member positioned in said housing on an opposite side of said first member from said second member and arranged coaxially with and parallel to said first member, said third member being rotatable relative to said first member and cooperating therewith to form another open circumferential screening gap between said outer peripheral edge of said first member and an adjacent outer peripheral edge of said third member, said another screening gap communicating with said supply chamber and said collecting chamber.

6. Apparatus according to claim 5, wherein at least one of said first, second, and third members is rotatable about an axis of rotation, each of said screening gaps formed by said first, second, and third members being positioned the same distance, measured in a radial direction, from said axis of rotation.

7. Apparatus according to claim 5, wherein said defibrating means defibrates coarse suspension materials passing from said supply chamber to said collecting chamber through each of said screening gaps, said defibrating means including a first projection extending into one of said screening gaps from one of said first and second members and a second projection extending into the other of said screening gaps from one of said first and third members, whereby said first and second projections reject as well as defibrate coarse materials in pulp suspensions passing from said supply chamber to said collecting chamber through said screening gaps so as to inhibit clogging of both of said screening gaps.

8. Apparatus according to claim 1, wherein said inhibiting means includes a plurality of projections, each of said projections extending into said screening gap from one of said first and second members.

9. Screening apparatus for fractionating material suspensions, comprising a first stationary member; a second rotatable member positioned on one side of said first member and arranged coaxially with and parallel to said first member, said second member being rotatable relative to said first member and cooperating therewith to form an open circumferential screening gap between adjacent outer peripheral edges of said first and second members; a supply chamber located radially outwardly of said screening gap and communicating therewith; a collecting chamber located radially inwardly of said screening gap and communicating therewith; inhibiting means for inhibiting the clogging of said screening gap with coarse suspension materials passing from said supply chamber to said collecting chamber through said screening gap, said inhibiting means including at least one projection extending into said screening gap from one of said first and second members, whereby said at least one projection rejects or defibrates coarse materials in suspensions passing from supply chamber to said collecting chamber through said screening gap so as to maintain said screening gap substantially open; and removing means extending from said second member and overlapping said screening gap for removing coarse suspension materials stuck in said screening gap.

10. Apparatus according to claim 9, wherein said second member includes an annular ring, which delimits one side of said screening gap, and said removing means includes a plurality of wiper elements, which are attached to and spaced apart around an outer peripheral edge of said annular ring, each of said wiper elements being positioned in close proximity to said first member.

11. Apparatus according to claim 10, wherein each of said wiper elements includes producing means for producing pulsations in material suspensions contained within said supply chamber.

12. Apparatus according to claim 11, wherein said producing means includes a plurality of blades, each of said blades being mounted on a corresponding one of said wiper elements.

13. Apparatus according to claim 9, wherein said removing means includes producing means for producing pulsations in material suspensions contained within said supply chamber.

14. Screening apparatus for fractionating material suspensions, comprising a first stationary member; a second rotatable member positioned on one side of said first member and arranged coaxially with and parallel to said first member, said second member being rotatable relative to said first member and cooperating therewith to form an open circumferential screening gap between adjacent outer peripheral edges of said first and second members, said second member including an annular ring which delimits one side of said screening gap; a supply chamber located radially outwardly of said screening gap and communicating therewith; a collecting chamber located radially inwardly of said screening gap and communicating therewith; inhibiting means for inhibiting the clogging of said screening gap with coarse suspension materials passing from said supply chamber to said collecting chamber through said screening gap, said inhibiting means including at least one projection extending into said screening gap from one of said first and second members, whereby said at least one projection rejects or defibrates coarse materials in suspensions passing from said supply chamber to said collecting chamber through said screening gap so as to maintain said screening gap substantially open; and generating means, provided on an outer peripheral edge of said annular ring, for generating pulsations in material suspensions passing through said screening gap to said collecting chamber.

15. Apparatus according to claim 10, wherein said generating means includes a plurality of generally flat surfaces formed on and spaced apart around said outer peripheral edge of said annular ring, each of said flat surfaces extending completely across said outer peripheral edge of said annular ring.

16. Screening apparatus for fractionating material suspensions, comprising a first member; a second member positioned on one side of said first member and arranged coaxially with and parallel to said first member, said second member being rotatable relative to said first member and cooperating therewith to form an open circumferential screening gap between adjacent outer peripheral edges of said first and second members; an annular supply chamber located radially outwardly of said screening gap and communicating therewith, said supply chamber including an inlet arranged tangentially with respect to said supply chamber; a collecting chamber located radially inwardly of said screening gap and communicating therewith; and inhibiting means inhibiting the clogging of said screening gap with coarse suspension materials passing from said supply chamber to said collecting chamber through said screening gap, said inhibiting means including at least one projection extending into said screening gap from one of said first and second members, whereby said at least one projection rejects or defibrates coarse materials in suspensions passing from said supply chamber to said collecting chamber through said screening gap so as to maintain said screening gap substantially open.

* * * * *